United States Patent [19]

Dremann

[11] 4,385,030

[45] May 24, 1983

[54] MAGNESIUM FERROSILICON ALLOY AND USE THEREOF IN MANUFACTURE OF MODULAR CAST IRON

[75] Inventor: Charles E. Dremann, Charlestown Township, Chester County, Pa.

[73] Assignee: Foote Mineral Company, Exton, Pa.

[21] Appl. No.: 370,185

[22] Filed: Apr. 21, 1982

[51] Int. Cl.[3] ..... C22C 33/08

[52] U.S. Cl. ..... 420/578; 75/53; 75/130 A

[58] Field of Search ..... 75/27, 53, 58, 130 R, 75/154 S, 130 AB

[56] References Cited

U.S. PATENT DOCUMENTS

| | | | |
|---|---|---|---|
| 2,873,188 | 2/1959 | Bieniosek | 75/130 R |
| 3,537,842 | 11/1970 | Holland | 75/58 |
| 3,703,922 | 11/1972 | Dunks et al. | 164/57 |
| 4,004,630 | 1/1977 | Dunks | 164/57 |
| 4,224,069 | 9/1980 | Shea et al. | 75/255 |

OTHER PUBLICATIONS

Technical Data Bulletin No. 213-A: "Noduloy ® 5LC Magnesium Ferrosilicon for In-Mold Nodularization", Foote Mineral Company, (1980).

"In-the-Mold Treatment Using Elemental Magnesium to Produce Ductile Iron", Shea et al., Transactions of the American Foundryman's Society, 86, 13-22, (1978).

*Primary Examiner*—P. D. Rosenberg

*Attorney, Agent, or Firm*—Howson and Howson

[57] ABSTRACT

A magnesium ferrosilicon alloy for in-mold nodulization of ductile iron consisting of 5-15%, by weight of magnesium, 60-80% silicon, 0.1-1.5% calcium, 0.1-3.0% aluminum, 0-2.5% rare earth, and balance iron.

4 Claims, No Drawings

MAGNESIUM FERROSILICON ALLOY AND USE THEREOF IN MANUFACTURE OF MODULAR CAST IRON

This invention relates to a novel magnesium ferrosilicon alloy, and to an improved process for the production of nodular or spheroidal graphite iron castings using such alloy.

BACKGROUND OF THE INVENTION

The carbon present in molten iron is normally in so-called flake form, and if the metal solidifies with the carbon in such form, the cast metal has low elongation and low tensile strength, making it unsuitable for certain uses. For a number of years it has been known that flake graphite can be converted to the nodular form by the use of so-called nodulizing agents, which initially were used to treat gray iron as it flowed from the melting furnance or when it was received in the ladle from which castings were poured.

More recently, the so-called in-mold process for producing nodular cast iron was developed. In this process, the mold is provided with a separate reaction chamber which contains a nodulizing agent. Molten metal to be cast comes into contact with the nodulizing agent before it enters the mold cavity. The nodulizing agent is taken up into the molten metal at a relatively uniform rate whereby the metal is uniformly treated leading to uniformity of properties throughout the cast metal.

In the in-mold process for producing nodular iron, the nodulizing agent used commercially to the substantial exclusion of all others in a magnesium ferrosilicon alloy containing on the order of 5 to 7 percent, by weight, of magnesium, about 43 to 48 percent silicon and balance iron. In certain alloys of this type, a small amount of rare earth metal, such as cerium, has been added to neutralize the effects of so-called tramp elements, and small amounts of calcium and aluminum have been included to provide graphite nucleation resulting in higher nodule counts in the cast metal. There has also been offered for sale a nodulizing agent comprising a mechanical mixture of granular magnesium and granular ferrosilicon alloy (50% Si), in the weight ratio of about one part of the former to about 15 parts of the latter, but the portion of the market represented by this product is substantially negilible.

Both of the above-described commercial products have undesirable characteristics. Magnesium ferrosilicon (43–48% Si) alloy dissolves in the molten iron at a relatively slow rate. Since casting parameters, such as casting time, temperature of metal being cast, etc. vary widely from foundry to foundry, the obtaining of inconsistent results has been a problem. Also, with such a relatively slow dissolving nodulizer, the configuration of the reaction chamber must be such as to expose to the molten metal being cast the largest possible surface area. With such an arrangement, the nodulizer, which generally is used in particulate form, may be carried as such into the casting causing undesirable defects and a less uniform casting. Further, by reason of the relatively slow rate of dissolution of the magnesium ferrosilicon (43–48% Si), there are limitations on pour time and minimum temperature of metal being poured.

The mechanical mixture of magnesium and ferrosilicon (50% Si), in addition to suffering from the same deficiencies of the magnesium ferrosilicon alloy discussed above, can undergo particle segregation in manufacture and shipment by reason of the substantial disparity between the density of magnesium (1.7 g/cc) and 50% ferrosilicon (4.5 g/cc), resulting in erratic casting results.

OBJECT OF THE INVENTION

An object of this invention is to provide a novel alloy for the manufacture of nodular iron, which alloy is relatively fast dissolving making possible decreased pouring times even with vertically parted (Disamatic) molds.

Another object of this invention is the provision of improved inoculation for production of ductile iron having a higher nodular count and a higher ferrite content.

Still another object of the invention is an improved in-mold process for the manufacture of nodular iron employing a novel nodulizing agent whereby cleaner castings are obtained at lower casting temperatures using reaction chambers of improved geometry.

These and other objects of this invention will become apparent from the following description of preferred embodiments of the invention.

BRIEF DESCRIPTION OF THE INVENTION

In accordance with this invention there is provided a novel nodulizing agent for manufacture of nodular iron castings in the form of a magnesium ferrosilicon alloy comprising about 5 to 15 percent magnesium, 60 to 80 percent silicon, 0.1 to 1.5 percent calcium, 0.1 to 3.0 percent aluminum, up to 2.5 percent rare earth, and balance iron. Preferably such alloy contains 7.5 to 9.5 percent magnesium, 65 to 70 percent silicon, 0.3 to 0.5 percent calcium, 0.8 to 1.3 percent aluminum, 0.2 to 0.5 percent rare earth, predominantly cerium, and balance iron.

According to the process of this invention, nodular graphite iron castings are obtained by introducing molten carbon-containing iron to a mold cavity by way of a gating system which includes at least one intermediate reaction chamber containing the nodulizing agent of this invention. The nodulizing agent is in particulate form and dissolves rapidly in the molten iron as the iron passes through the intermediate reaction chamber.

It was discovered that the novel magnesium ferrosilicon alloys of this invention provide a number of distinct advantages over alloys heretofore used to produce nodular graphite iron castings. More particularly, the alloys are faster dissolving and thus are able to respond to faster pouring times. This is the case even when the alloys are used in vertically parted (Disamatic) molds.

As noted previously, prior known alloys for producing nodular iron dissolve in molten metal relatively slowly. For this reason, in in-mold casting of iron, wide, relatively shallow reaction chambers have been used. Unfortunately, it is difficult to place alloy granules uniformly in such a reaction chamber, resulting in uneven treatment of the molten metal and, in some cases, alloy granules have been swept into the casting resulting in defects. Advantageously, by reason of the fast dissolving characteristics of the present alloys, reaction chambers of improved geometry, e.g. deeper and of narrower cross section, can be used whereby the chance of alloy drag over into the casting is greatly reduced.

Being faster dissolving the novel alloys provide desired results with molten iron at lower temperatures, and lend themselves better to pouring delays. Also, the resulting castings are cleaner for the alloys rapidly dissolve in and react with the molten metal before the metal reaches the mold cavity. Alloy which is still reacting as it enters the mold cavity will produce undesirable reaction products such as magnesium oxide, magnesium sulfide and magnesium silicate, which cause unwanted inclusions and surface defects in the casting. For alloys, such as the present alloy, which completely dissolve in the chamber, any reaction products formed have time to float out of the molten metal and be trapped on the way to the castingcavity and, thus do not form undesirable inclusions in the cast metal. In addition, the alloys of this invention provide ductile iron having a higher nodule count and a higher ferrite count.

DETAILED DESCRIPTION OF THE INVENTION

The alloys of this invention have the composition as set forth in Table I, below:

TABLE I

| Constituent | Weight Percent Generally | Weight Percent Preferred |
|---|---|---|
| Magnesium | 5–15 | 7.5–9.5 |
| Silicon | 60–80 | 65–70 |
| Calcium | 0.1–1.5 | 0.3–0.5 |
| Aluminum | 0.1–3.0 | 0.8–1.3 |
| Rare earth | .0–2.5 | 0.2–0.5 |
| Iron | Balance | Balance |

Preferably the rare earth is predominately cerium and/or lanthanum.

The alloys may be prepared by plunging magnesium into nominal 75% ferrosilicon alloy. The alloys are relatively easy to manufacture using such procedure since the higher silicon content of the ferrosilicon alloy reduces the violence of the reaction, smoke and flare being markedly reduced.

The 75% ferrosilicon alloy in which the magnesium metal is plunged can be prepared by standard smelting teniques well known in the metallurgical art and need no description here. In the alloy the calcium and aluminum are usually present as impurities. However, the calcium and aluminum serve a useful function in that they prevent or lessen the formation of hard iron carbides in those areas, e.g. thin sections, of a casting which cool first. The presence of hard iron carbides interfers with the machinability of the casting. Rare earths give protection against deliterious impurities occasionally found in cast iron.

The fact that the alloys of this invention dissolve faster than similar alloys containing on the order of 45–50% silicon is believed to be due to three important factors, namely, the melting point of the alloys, the exothermic influence of silicon on the iron, and the magnesium content. As the silicon content is increased above 60% the melting point of the alloy increases. At the same time, the heat of solution increases markedly. For a given magnesium content in the alloy, the combination of these two opposing influences—melting point and the exothermic nature of silicon in iron—produces a maximum overall dissolution rate at about 65–75% silicon. As the magnesium content of the alloy is increased, dissolution rate of the alloy also increases. However, a practical limit of magnesium contents is reached beyond which actual recovery of magnesium in the cast iron begins to markedly decrease. This is due to the fact that, since casting temperatures are above the boiling point of magnesium (1090° C., 1994° F.), magnesium enters the molten iron as a gas which must be metered carefully to the iron to avoid poor recovery in the iron and build up of back pressure which inhibits metal flow into the casting chamber. Thus, the preferred range of magnesium in the alloy is about 7.5 to 9.5% in order to provide rapid dissolution without appreciably decreasing the flow of metal into the mold or recovery of magnesium in the cast iron.

The following examples serve to further illustrate this invention:

EXAMPLES 1 TO 6

A number of separate magnesium ferrosilicon alloys were prepared by plunging solid magnesium into nominal 75% ferrosilicon in an amount such that the alloys had the composition set forth in Table II below.

In casting the iron, the apparatus comprised a mold having a gating system which included an intermediate reaction chamber provided with a fused silica window. The molten iron at 2550° F. introduced to the gating system was permitted to exit the mold and samples thereof were caught in separate molds, and the cast metal was studied to determine its degree of nodularity. 110 cc portions of various alloys of this invention having the respective compositions given in Table II, and having a particle size such that all particles passed through a 5 mesh screen but were retained on an 18 mesh screen, were placed in the intermediate reaction zone. Moving pictures were taken of the fused silica window on the side of the reaction chamber employing a camera fitted with an 8:1 telephoto lens. Wide angle motion pictures were also taken of the overall apparatus, which included the mold, pouring ladle, molten metal collector and a clock. The pictures enabled determination of the total pouring time and dissolution time. Nodularity was determined by studies of the microstructure of the cast samples. The results of the several tests are given in Table II.

The tests were repeated employing two different alloys of the type heretofore used commercially, which alloys contain on the order of about 46 percent silicon. These tests are identified in Table II as Examples 7 and 8, and it can be seen that the dissolution times for the prior known alloys is generally about 50 to 100 percent longer than for alloys of the present invention (See Examples 1 to 6).

TABLE II

Window Mold Tests of Magnesium-Ferrosilicon Alloys

| Example No. | Alloy Weight Total (g) | Alloy Weight Mg (g) Calculated | Composition % Si | % Ca | % Al | % Mg | % Ce | Pour Time (sec) | Dissolution Time Wide Angle (sec) | Dissolution Time Telephoto (sec) | Nodularity (% - time of last good sample) |
|---|---|---|---|---|---|---|---|---|---|---|---|
| 1 | 167 | 9.9 | 66.0 | 0.5 | 0.8 | 5.9 | * | 30 | 16 | 13 | 97% - 15 sec |
| 2 | 165 | 10.4 | 70.2 | 0.4 | 1.1 | 6.3 | 0.1 | 29 | 12 | 13 | 97% - 12 sec |
| 3 | 155 | 15.0 | 65.7 | 0.5 | 0.7 | 9.7 | * | 30 | 17 | 17 | 97% - 16 sec |
| 4 | 140 | 14.6 | 75.7 | 0.3 | 0.6 | 10.4 | * | 31 | 18 | 17 | 96% - 17 sec |
| 5 | 171 | 15.6 | 64.9 | 0.5 | 1.0 | 9.1 | 0.5 | 31 | 17 | 17 | 95% - 17 sec |

TABLE II-continued

| Window Mold Tests of Magnesium-Ferrosilicon Alloys | | | | | | | | | | | |
|---|---|---|---|---|---|---|---|---|---|---|---|
| | Alloy | | | | | | | | | | |
| | Weight | | Composition | | | | | Pour | Dissolution Time | | Nodularity |
| Example No. | Total (g) | Mg (g) Calculated | % Si | % Ca | % Al | % Mg | % Ce | Time (sec) | Wide Angle (sec) | Telephoto (sec) | (% - time of last good sample) |
| 6 | 176 | 12.5 | 67.9 | 0.4 | 0.8 | 7.1 | 0.3 | 30 | 15 | ** | 98% - 16 sec |
| 7 | 259 | 14.5 | 46.4 | 0.2 | 0.8 | 5.6 | 0.3 | 28 | 22 | 22 | 95% - 17 sec |
| 8 | 223 | 16.5 | 46.6 | 0.8 | 1.1 | 7.4 | 0.5 | 33 | 24 | 21 | 91% - 23 sec |

*not analyzed, no cerium intentionally added
**camera failed

I claim:

1. A magnesium ferrosilicon alloy particularly suitable for in-mold nodulization of ductile iron comprising from about 5 to about 15 percent magnesium, from about 60 to 80 percent silicon, from about 0.1 to about 1.5 percent calcium, from about 0.1 to 3.0 percent aluminum, up to about 2.5 percent rare earth, and balance iron, said percentages being by weight based on the total weight of said alloy.

2. An alloy according to claim 1 comprising from about 7.5 to about 9.5 percent magnesium, from about 65 to 70 percent silicon from about 0.3 to about 0.5 percent calcium, from about 0.8 to about 1.3 percent aluminum, from about 0.2 to about 0.5 percent rare earth, predominantly cerium, and balance iron.

3. In a process for the production of nodular graphite iron castings in which molten carbon-containing iron is introduced to a mold by way of a mold inlet and travels to a mold cavity by way of a gating system which includes at least one intermediate chamber containing a nodulizing agent in an amount to convert the carbon to nodular graphite, the improvement which comprises employing as said nodulizing agent a magnesium ferrosilicon alloy comprising from about 5 to about 15 percent magnesium, from about 60 to 80 percent silicon, from about 0.1 to about 1.5 percent calcium, from about 0.1 to 3.0 percent aluminum, up to about 2.5 percent rare earth, and balance iron, said percentages being by weight based on the total weight of said alloy.

4. The process according to claim 3 in which said magnesium ferrosilicon alloy comprises from about 7.5 to about 9.5 percent magnesium, from about 65 to 70 percent silicon, from about 0.3 to 0.5 percent calcium, from about 0.8 to about 1.3 percent aluminum, from about 0.2 to about 0.5 percent rare earth predominantly cerium, and balance iron.

* * * * *